US007926804B2

(12) United States Patent
Chinzei et al.

(10) Patent No.: US 7,926,804 B2
(45) Date of Patent: Apr. 19, 2011

(54) TRANSPORT APPARATUS

(75) Inventors: Kiyoshi Chinzei, Daito (JP); Shingo Kimoto, Daito (JP)

(73) Assignee: Seiko Epson Corporation, Tokyo (JP)

( * ) Notice: Subject to any disclaimer, the term of this patent is extended or adjusted under 35 U.S.C. 154(b) by 85 days.

(21) Appl. No.: 12/398,767

(22) Filed: Mar. 5, 2009

(65) Prior Publication Data

US 2009/0224463 A1 Sep. 10, 2009

(30) Foreign Application Priority Data

Mar. 6, 2008 (JP) ..... 2008-057083

(51) Int. Cl.
*B65H 1/00* (2006.01)

(52) U.S. Cl. ..... 271/162

(58) Field of Classification Search ..... 271/162, 271/163

See application file for complete search history.

(56) References Cited

U.S. PATENT DOCUMENTS 6,595,514 B2 * 7/2003 Takahashi ..... 271/162

FOREIGN PATENT DOCUMENTS

JP 2002-193497 A 7/2002
JP 2006-036379 A 2/2006

* cited by examiner

*Primary Examiner* — Stefanos Karmis
*Assistant Examiner* — Michael C McCullough
(74) *Attorney, Agent, or Firm* — Sughrue Mion, PLLC

(57) ABSTRACT

A transport apparatus for transporting a sheet-like article includes an apparatus main body, and a support tray that rotates between open and closed states defined with respect to the apparatus main body. The support tray supports the article during the open state. The support tray includes a flat tray main body, a rotation axis extending from the tray main body in an axial direction of the rotation. The rotation axis is axially supported by the apparatus main body, and an elastic tray protrusion protrudes from the tray main body in a radial direction of the rotation, the apparatus main body having a main-body contact portion facing the tray protrusion. When the support tray rotates relative to the apparatus main body, the tray protrusion elastically crosses over the main-body contact portion to contact the main-body contact portion. The rotation of the support tray stops relative to the apparatus main body.

6 Claims, 8 Drawing Sheets

TRANSPORT APPARATUS

CROSS REFERENCE TO RELATED APPLICATION

This patent application claims priority based on a Japanese patent application No. 2008-057083 filed on Mar. 6, 2008, the contents of which are incorporated herein by reference.

BACKGROUND

1. Technical Field

The present invention relates to a transport apparatus for transporting a sheet-like article. More particularly, the invention relates to a transport apparatus including a support tray that rotates between an open state and a closed state defined with respect to the main body of the transport apparatus and supports the sheet-like article during the open state.

2. Related Art

A known transport apparatus designed for transporting printing paper and the like has a paper tray that rotates between a closed state and an open stated defined with respect to the main body of the transport apparatus, for example, as disclosed in JP-A-2002-193497 and JP-A-2006-36379. In such a transport apparatus, the paper tray has a protrusion protruding in the direction of the rotation axis, and the main body of the transport apparatus has a fitting portion that fits the protrusion. By fitting the protrusion into the fitting portion, the paper tray becomes stationary in the open state and the closed state with respect to the main body of the transport apparatus.

Referring to the transport apparatus described above, the protrusion of the paper tray protrudes in the direction of the rotation axis. Therefore, assembling the paper tray with the main body of the transport apparatus is complicated since the rotation axis of the paper tray is fitted into the main body of the transport apparatus and the protrusion is additionally fitted into the main body of the transport apparatus.

SUMMARY

Therefore, it is an advantage of some aspects of the invention to provide a transport apparatus that overcomes the above issues in the related art. This advantage is achieved by combinations described in the independent claims. The dependent claims define further advantageous and exemplary combinations of the invention.

According to a first aspect of the invention, a transport apparatus for transporting a sheet-like article includes an apparatus main body, and a support tray that rotates between an open state and a closed state defined with respect to the apparatus main body, where the support tray supports the article during the open state. Here, the support tray includes a flat tray main body, a rotation axis that extends from the tray main body in an axial direction of the rotation, where the rotation axis is axially supported by the apparatus main body, and an elastic tray protrusion that protrudes from the tray main body in a radial direction of the rotation, the apparatus main body has a main-body contact portion that faces the tray protrusion, and when the support tray rotates with respect to the apparatus main body, the tray protrusion elastically crosses over the main-body contact portion to come into contact with the main-body contact portion, so that the rotation of the support tray stops with respect to the apparatus main body.

In the above-described transport apparatus, the tray protrusion may elastically cross over the main-body contact portion to come into contact with the main-body contact portion, to be positioned such that the support tray remains stationary in the closed state with respect to the apparatus main body.

In the above-described transport apparatus, the tray protrusion may elastically cross over the main-body contact portion to come into contact with the main-body contact portion, to be further positioned such that the support tray remains stationary in the open state with respect to the apparatus main body.

In the above-described transport apparatus, the support tray may further include an arc-like portion that is connected to the tray main body and shaped like an arc along a direction of the rotation, the tray protrusion may be provided on the arc-like portion so as to protrude in the radial direction of the rotation, and the support tray may further include a fan-like portion that is connected to the tray main body and is provided inside the arc-like portion with a slit therebetween.

In the above-described transport apparatus, the support tray may further include an arc-like portion that is connected to the tray main body and shaped like an arc along a direction of the rotation, the tray protrusion may be provided on the arc-like portion so as to protrude in the radial direction of the rotation, and, during the rotation of the support tray, the arc-like portion may move relative to the main-body contact portion with a contact therebetween.

The summary clause does not necessarily describe all necessary features of the embodiments of the invention. The invention may also be a sub-combination of the features described above. The above and other features and advantages of the invention will become more apparent from the following description of the embodiments taken in conjunction with the accompanying drawings.

DESCRIPTION OF EXEMPLARY EMBODIMENTS

Some aspects of the invention will now be described based on the embodiments, which do not intend to limit the scope of the invention, but exemplify the invention. All of the features and the combinations thereof described in the embodiment are not necessarily essential to the invention.

Figure 1:
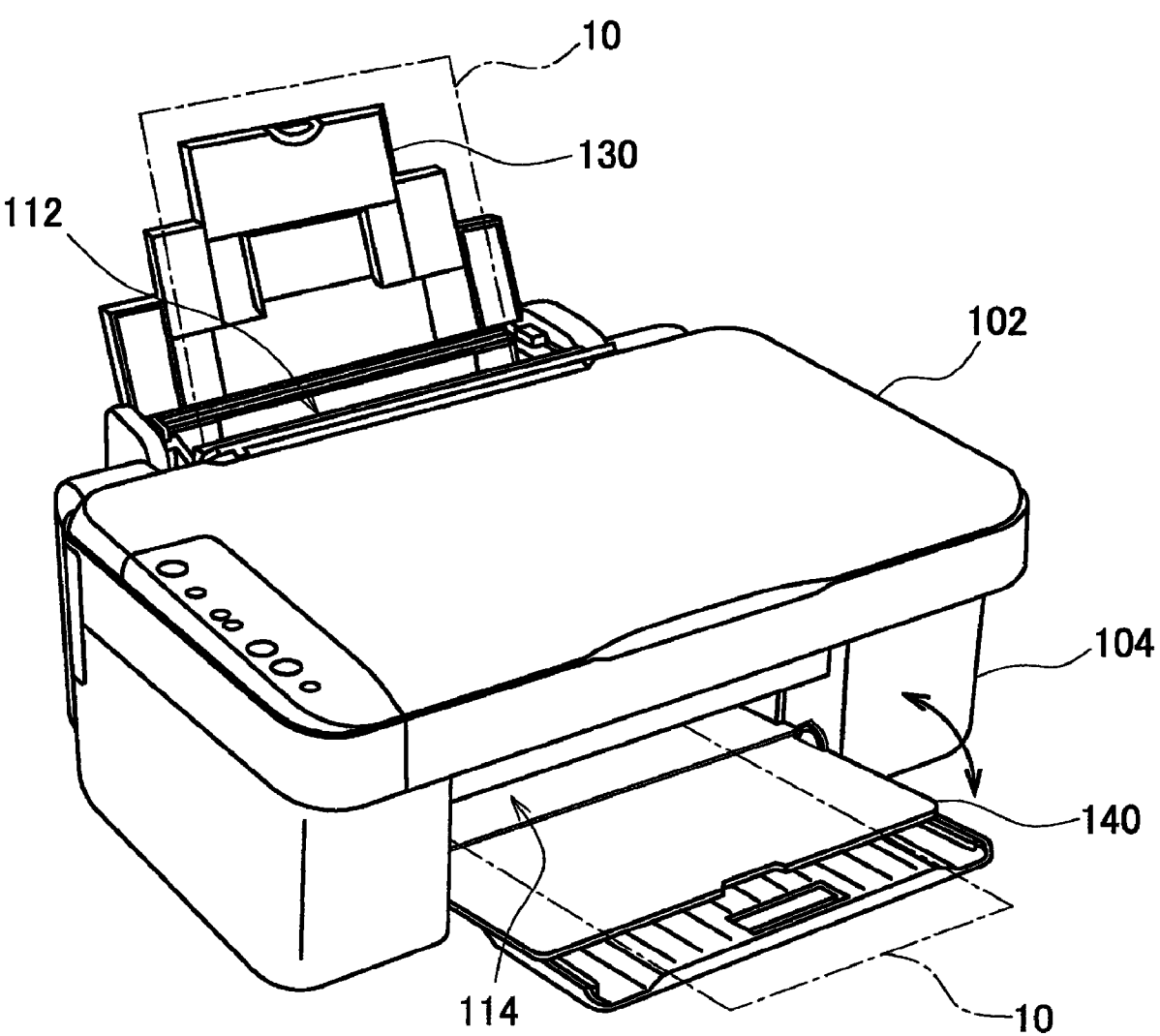
FIG. 1 is an external perspective view illustrating a combination apparatus 100, which is shown as an example of a transport apparatus.

FIG. 1 is an external perspective view illustrating a combination apparatus 100, which is shown as an example of a transport apparatus. The combination apparatus 100 includes a scanner 102 and a printer 104, which are integrated together. The scanner 102 optically reads a document, to generate electronic data. The printer 104 ejects an ink onto recording paper 10 fed from a paper entrance 112 to achieve printing, and discharges the printed recording paper 10 through a paper exit 114. The combination apparatus 100 further includes a feeding tray 130 and a discharging tray 140. The feeding tray 130 supports the sheet-like recording paper 10 fed into the paper entrance 112, and the discharging tray 140 supports the recording paper 10 discharged from the paper exit 114. It should be noted that the combination apparatus 100 is an example of a transport apparatus and transports the recording paper 10 from the paper entrance 112 to the paper exit 114.

The discharging tray 140 is axially supported so as to be rotatable (in the direction indicated by the arrow in FIG. 1) between a closed state and an open state defined with respect to the printer 104. While in the closed state with respect to the printer 104, the discharging tray 140 covers the paper exit 114 and stands upright. On the other hand, while in the open state with respect to the printer 104, the discharging tray 140 allows the paper exit 114 to be exposed and extends horizontally to support the recording paper 10.

Here, the feeding tray 130 may be also axially supported so as to be rotatable between a closed state and an open state defined with respect to the printer 104. In this case, the feeding tray 130 may have a rotating mechanism that is configured in the same manner as the rotating mechanism of the discharging tray 140. Note that the discharging tray 140 and the feeding tray 130 are each shown as an example of a support tray. In the following section of the description, the discharging tray 140 is explained and the feeding tray 130 is not.

Figure 2:
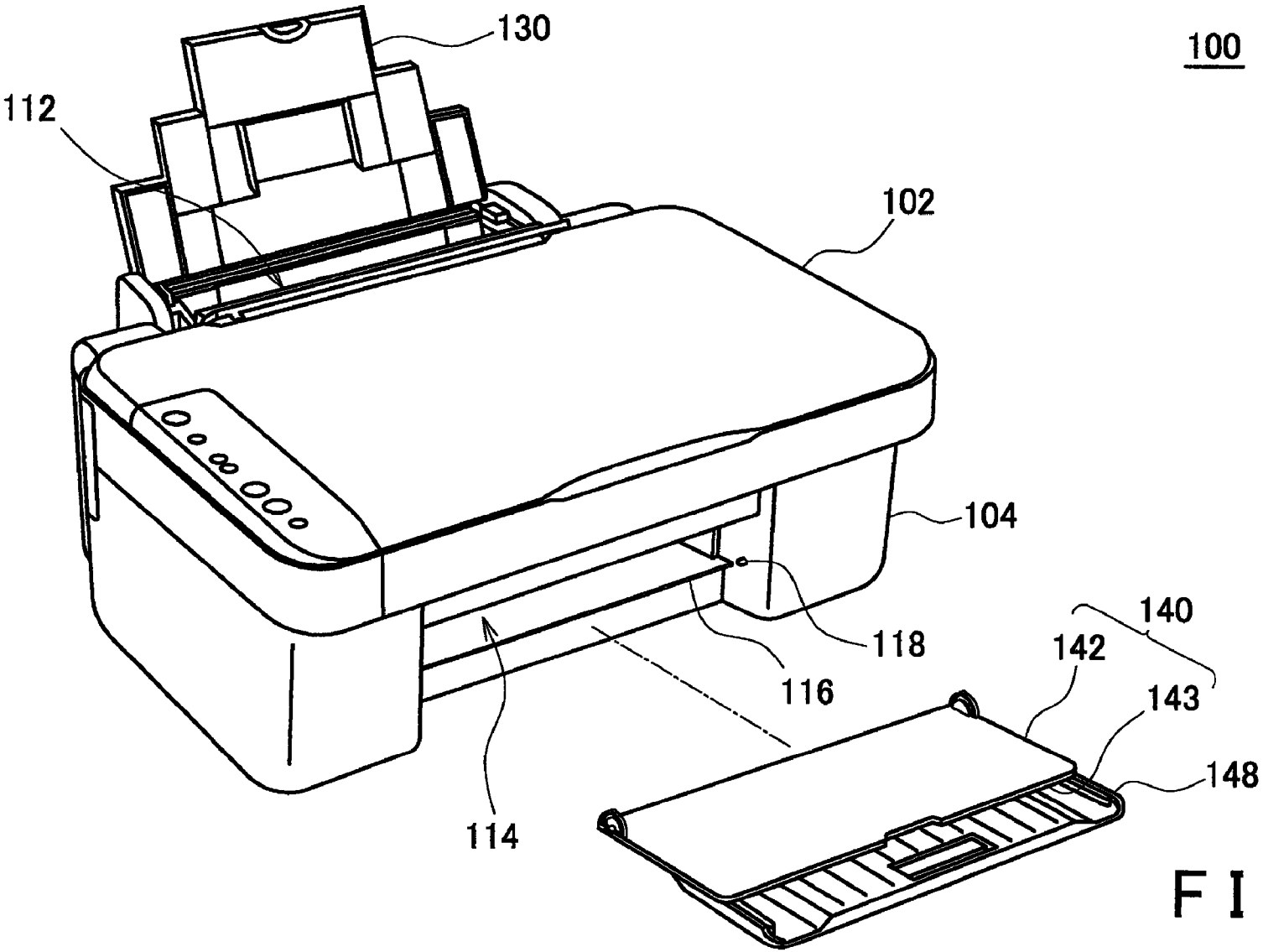
FIG. 2 is an exploded perspective view illustrating the combination apparatus 100, in which a discharging tray 140 is removed from a printer 104.

FIG. 2 is an exploded perspective view illustrating the combination apparatus 100, in which the discharging tray 140 is removed from the printer 104. As shown in FIG. 2, paired holes 118 are provided in opposing side surfaces of the paper exit 114 of the combination apparatus 100. In the bottom surface of the paper exit 114 of the combination apparatus 100, a main-body contact portion 116 is provided so as to protrude frontward. The discharging tray 140 includes a flat tray main body 142 and an extendable portion 148 that is positioned on the side of a front edge 143 of the tray main body 142. The extendable portion 148 extends and contracts with respect to the tray main body 142.

Figure 3:
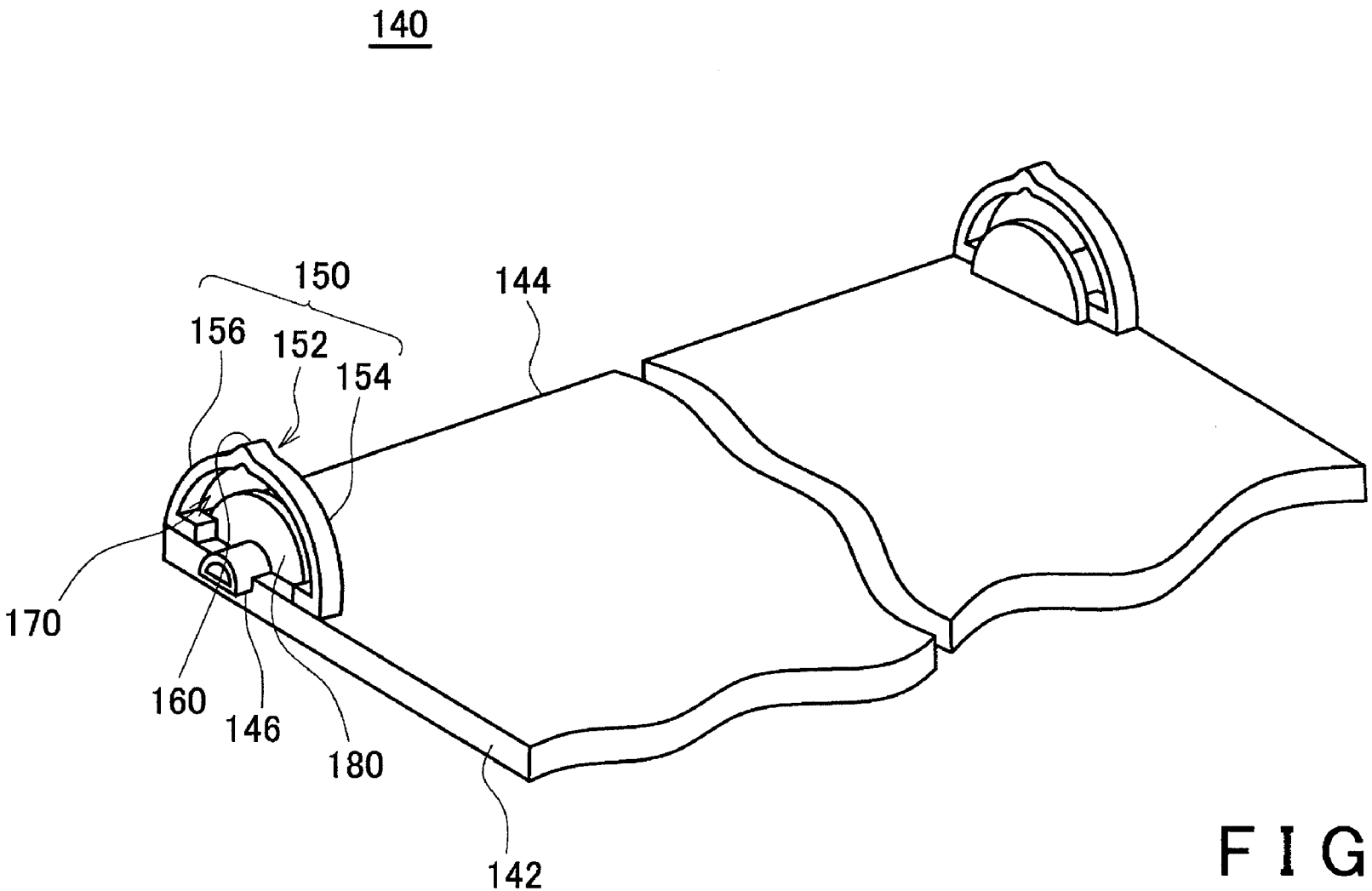
FIG. 3 is a partial enlargement view illustrating the discharging tray 140.

FIG. 3 is a partial enlargement view illustrating the discharging tray 140. In addition to the tray main body 142, the discharging tray 140 includes a rotation axis 146, an arc-like portion 150, a tray protrusion 160, and a fan-like portion 180. The rotation axis 146 extends from the tray main body 142 in the axial direction of the rotation. The arc-like portion 150 is connected to the tray main body 142 and shaped like an arc along the direction of the rotation. The tray protrusion 160 is elastic and provided on the arc-like portion 150 so as to protrude in the radial direction of the rotation. The fan-like portion 180 is connected to the tray main body 142 and positioned inside the arc-like portion 150 with a slit 170 being provided therebetween.

There are paired rotation axes 146 disposed in the vicinity of a rear edge 144 of the tray main body 142 on the left and right sides, and each rotation axis 146 is rotatably supported by the corresponding hole 118. In other words, when the rotation axes 146 are fitted into the holes 118 of the paper exit 114, the discharging tray 140 is assembled with the printer 104 so as to be rotatable about the rotation axes 146.

Similarly, there are paired arc-like portions 150, paired tray protrusions 160, and paired fan-like portions 180 disposed on the left and right sides. The tray main body 142, the rotation axes 146, the arc-like portions 150, the tray protrusions 160 and the fan-like portions 180 are together formed as a single piece by using a resin, such as high impact polystyrene (HIPS).

Each arc-like portion 150 has an upper arc-like portion 154 and a lower arc-like portion 156 with the tray protrusion 160 therebetween. The upper arc-like portion 154 is equivalent to a portion of a circumference about the rotation axis 146. On the other hand, the lower arc-like portion 156 is equivalent to a portion of a different circumference about the rotation axis 146 that has a smaller radius than the circumference for the upper arc-like portion 154. When the discharging tray 140 rotates, it is the lower arc-like portion 156 which faces the main-body contact portion 116. Furthermore, each arc-like portion 150 has a depression 152 on the side of the upper arc-like portion 154 so as to be adjacent to the tray protrusion 160. Note that the terms "upper" and "lower" are used for illustration purpose only to represent the relative positions with respect to the tray protrusions 160 when the discharging tray 140 is in the closed state and do not limit spatial positions.

Figure 4:
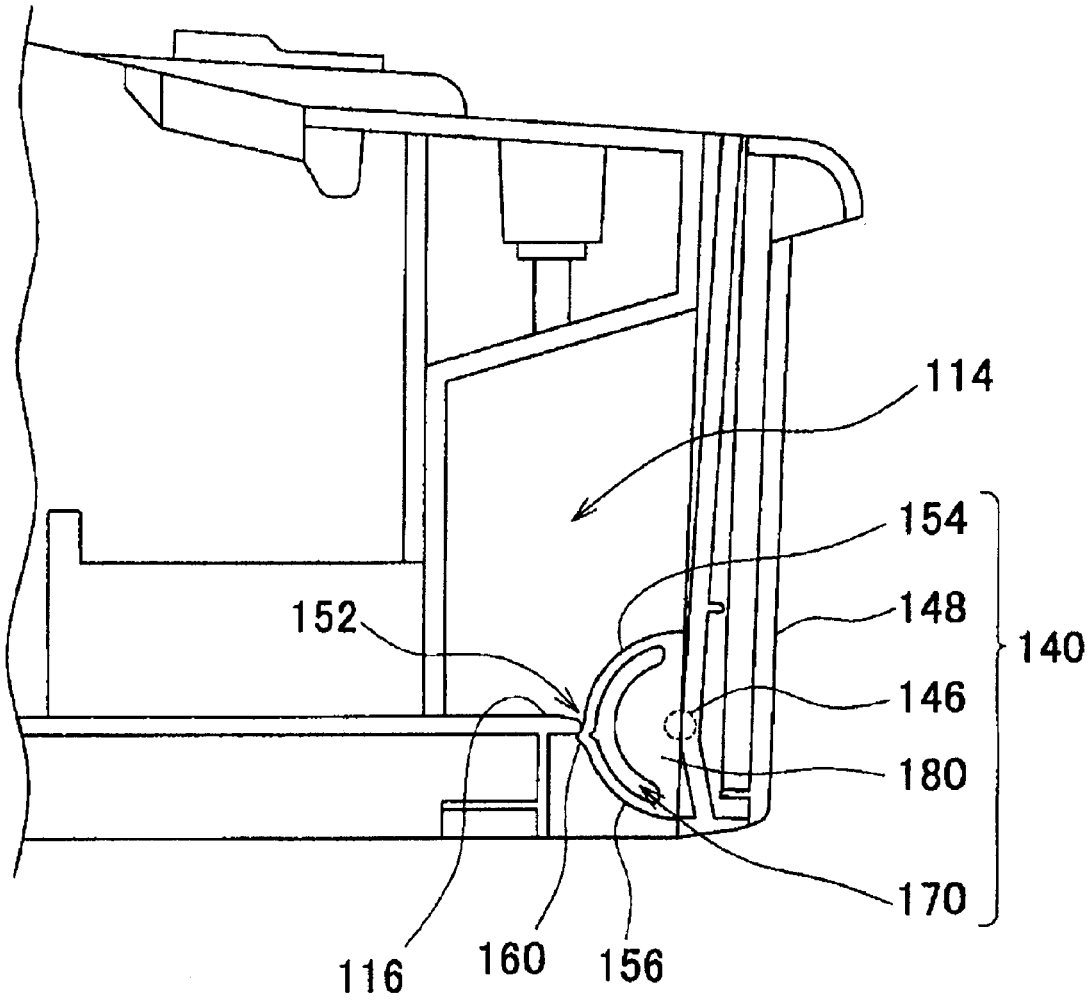
FIG. 4 is a partial side view illustrating a closed state of the discharging tray 140.
Figure 5:
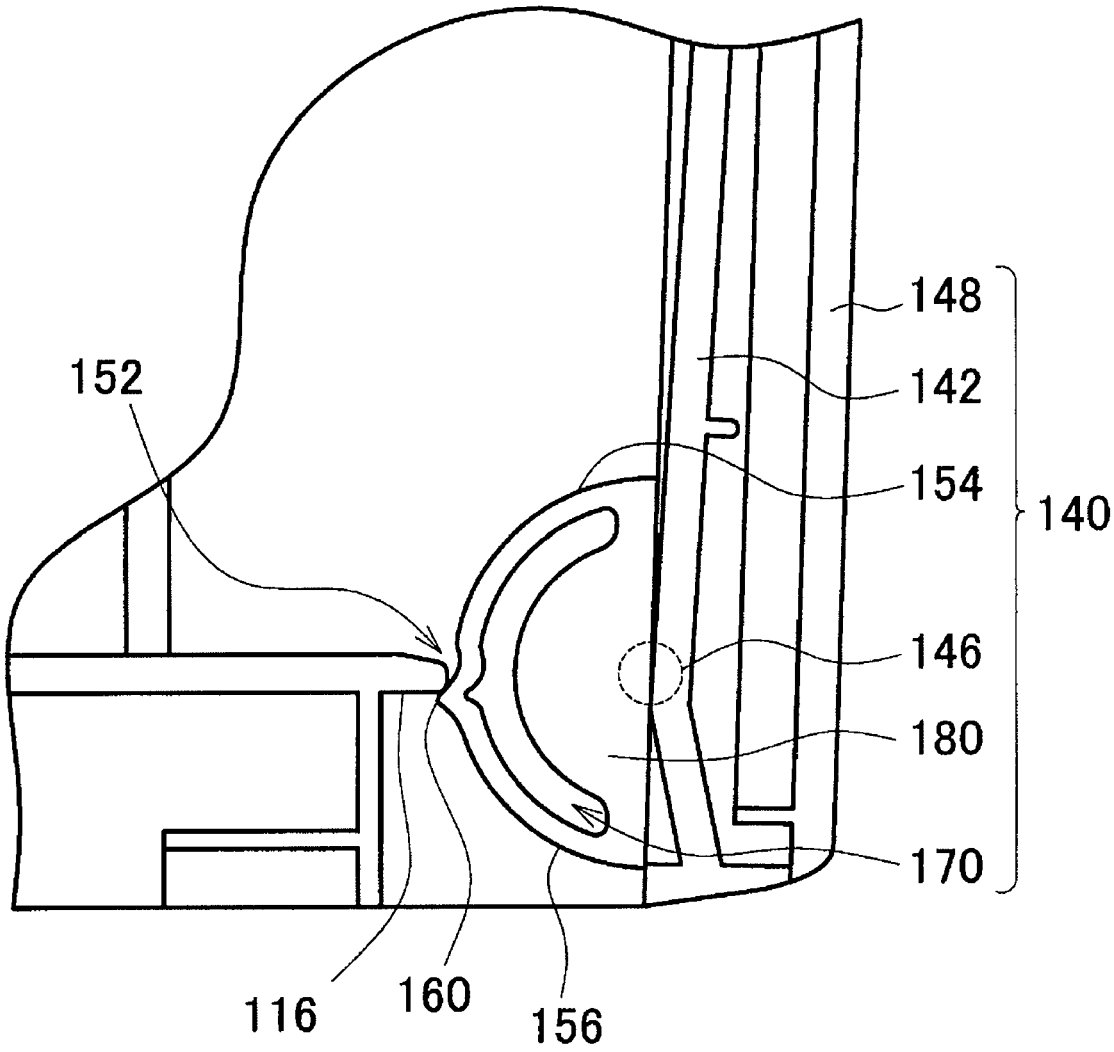
FIG. 5 is a partial enlargement view of FIG. 4.

FIG. 4 is a partial side view illustrating the closed state of the discharging tray 140, and FIG. 5 is a partial enlargement view of FIG. 4. As shown in FIGS. 4 and 5, the main-body contact portion 116 is positioned so as to oppose the tray protrusion 160. When the discharging tray 140 is in the closed state, the tray protrusion 160 is positioned lower than the main-body contact portion 116 and the main-body contact portion 116 is engaged with the depression 152, so that the discharging tray 140 is stationary. In other words, the tray protrusion 160 is positioned such that the discharging tray 140 is stationary in the closed state. According to an embodiment shown in FIG. 4, the tray protrusion 160 is positioned on the apex of the arc-like portion 150, that is to say, so as to have the largest distance from the tray main body 142. The position of the tray protrusion 160 is not limited to such.

Figure 6:
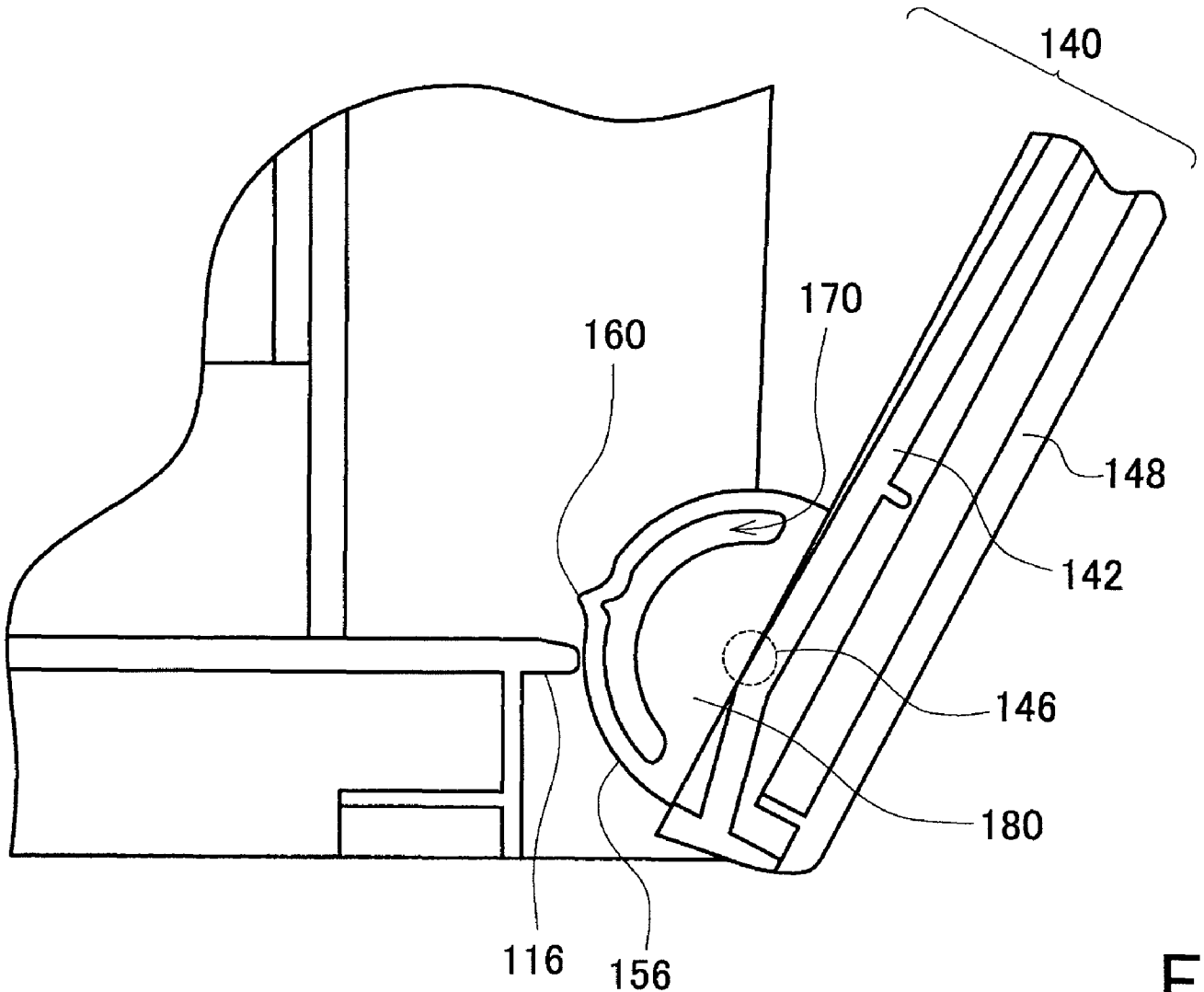
FIG. 6 is a partial enlargement view illustrating how the discharging tray 140 rotates.

FIG. 6 is a partial enlargement view illustrating how the discharging tray 140 rotates. When the discharging tray 140 is rotated (clockwise in FIG. 6) by manual manipulation by a user from the closed state shown in FIG. 5 to an open state, the tray protrusion 160 elastically crosses over the main-body contact portion 116, to start rotation around the rotation axis 146. In other words, unless the user applies force to create sufficient elastic deformation for enabling the tray protrusion 160 to cross over the main-body contact portion 116, the discharging tray 140 does not rotate. Therefore, except for a case where the user applies force, the discharging tray 140 can be prevented from jouncing or opening while the combination apparatus 100 is moved. Furthermore, since the fan-like portion 180 is provided inside the arc-like portion 150 with a slit therebetween, the tray protrusion 160 is allowed to have elastic deformation to such an extent that the tray protrusion 160 can cross over the main-body contact portion 116 and, at the same time, can be prevented from experiencing excessive elastic deformation.

Similarly, when the discharging tray 140 is rotated from the state shown in FIG. 6 to the closed state shown in FIG. 4, the tray protrusion 160 elastically crosses over the main-body contact portion 116, and the main-body contact portion 116 engages with the depression 152. In this way, the discharging tray 140 becomes stationary in the closed state. Hence, the user can recognize that the discharging tray section 140 has surely rotated up to the closed state by feeling resistance created when the tray protrusion 160 crosses over the main-body contact portion 116, that is to say, a click.

Figure 7:
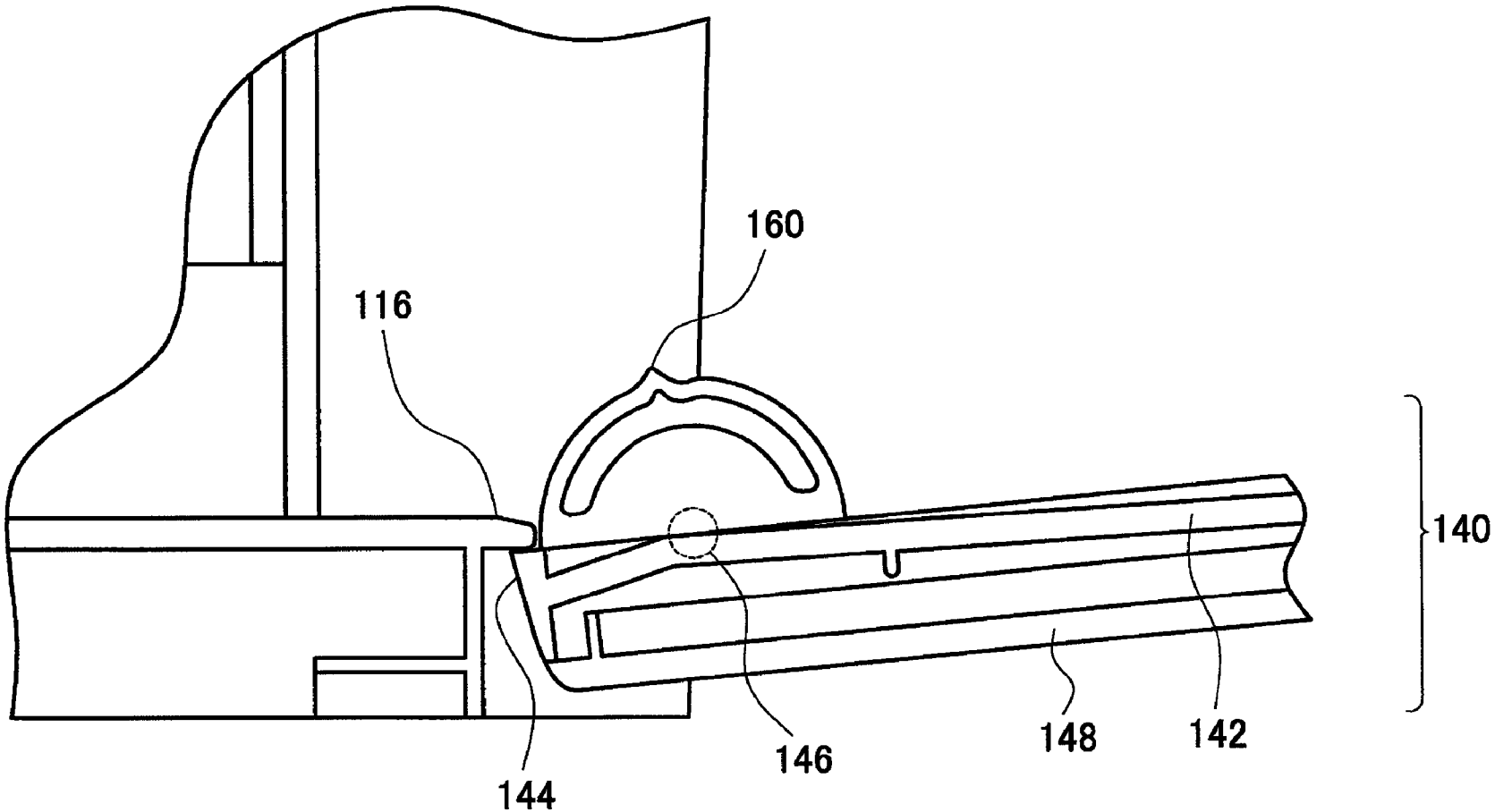
FIG. 7 is a partial enlargement view illustrating an open state of the discharging tray 140.

FIG. 7 is a partial enlargement view illustrating the open state of the discharging tray 140. When the discharging tray 140 is further rotated from the state shown in FIG. 6 to the open state, the rear edge 144 of the tray main body 142 finally comes into contact with the main-body contact portion 116, so that the discharging tray 140 becomes stationary in the open state. During the rotation shown in FIGS. 5 to 7, a gap is provided between the main-body contact portion 116 and the lower arc-like portions 156, which thus move relative to each other without a contact therebetween. Therefore, no resistance is generated between the main-body contact portion 116 and the lower arc-like portion 156. As a result, the discharging tray 140 can smoothly rotate.

According to the present embodiment described above, the discharging tray 140 is assembled with the printer 104 by fitting the rotation axis 146 into the hole 118 formed in the paper exit 114. Therefore, it becomes unnecessary to fit the tray protrusion 160 into a corresponding fitting portion separately from fitting the rotation axis 146, and the assembling procedure is thus simplified. In addition, the respective ends of the arc-like portion 150 are integrated into the tray main body 142 and the tray protrusion 160 is formed on the arc-like portion 150. In this manner, sufficient strength can be obtained against the elastic deformation. Furthermore, since the fan-like portion 180 is provided inside the arc-like portion 150 with a slit therebetween, the elastic deformation of the tray protrusion 160 can be allowed and excessive elastic deformation can be prevented.

Figure 8:
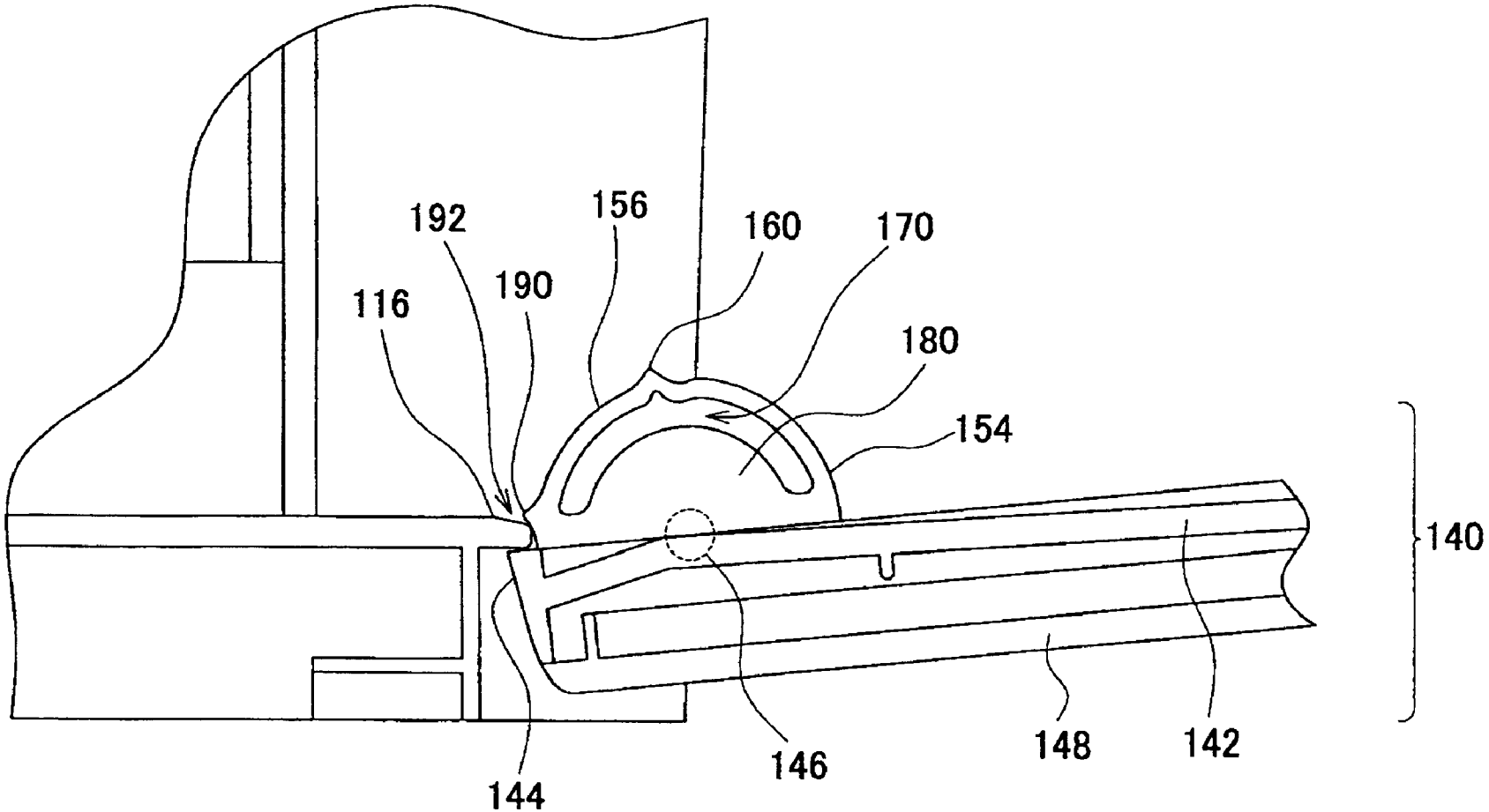
FIG. 8 is a partial enlargement view illustrating a different embodiment of the discharging tray 140.

FIG. 8 is a partial enlargement view illustrating a different embodiment of the discharging tray 140. In FIG. 8, the common constituents shared by the embodiment shown in this drawing and the embodiment described with reference to FIGS. 1 to 7 are assigned with the same reference numerals and are not explained here.

The discharging tray 140 shown in FIG. 8 has a tray protrusion 190 in addition to the constituents of the discharging tray 140 shown in FIGS. 1 to 7. The tray protrusion 190 is provided on the lower arc-like portion 156 in the vicinity of the tray main body 142. With such a configuration, when the tray protrusion 190 elastically crosses over the main-body contact portion 116 and then comes into contact with the main-body contact portion 116, the discharging tray 140 becomes stationary in the open state. Therefore, the tray protrusion 190 can contribute to more securely maintaining the discharging tray 140 stationary in the open state. As a result, the present embodiment can prevent the discharging tray 140 from jouncing or closing during its use. In this case, a depression 192 may be provided between the tray protrusion 190 and the read edge 144. With such a configuration, the main-body contact portion 116 engages with the depression 192 while the discharging tray 140 is in the open state, so that the discharging tray 140 may more securely remain stationary during the open state.

Furthermore, alternatively or additionally to the configuration of the discharging tray 140 shown in FIG. 8, the tray protrusion 190 may be provided so as to come into contact with the main-body contact portion 116 in the middle of the opening or closing procedure of the discharging tray 140, in other words, in the middle of the lower arc-like portion 156. With such a configuration, the discharging tray 140 can remain stationary at a halfway position between the open and closed states.

Referring to the discharging tray 140 described with reference to FIGS. 1 to 7, the main-body contact portion 116 is spaced away from the lower arc-like portion 156 during the rotation of the discharging tray 140 from the open state to the closed state. Alternatively, however, the lower arc-like portion 156 may apply elastic pressure to the main-body contact portion 116 so that the main-body contact portion 116 and the lower arc-like portion 156 move relative to each other while in contact with each other, during the rotation of the discharging tray 140 from the open state to the closed state. In this manner, even when the discharging tray 140 suddenly becomes free, for example, because the user loses his/her grip of the discharging tray 140, during the rotation of the discharging tray 140, the contact between the lower arc-like portion 156 and the main-body contact portion 116 can prevent radical rotation of the discharging tray 140.

Although some aspects of the invention have been described byway of exemplary embodiments, it should be understood that those skilled in the art might make many changes and substitutions without departing from the spirit and the scope of the invention which is defined only by the appended claims.

What is claimed is:

1. A transport apparatus for transporting an article, comprising:

an apparatus main body; and a support tray that rotates between an open state and a closed state defined with respect to the apparatus main body, the support tray supporting the article during the open state, wherein the support tray includes:

a flat tray main body;

a rotation axis that extends from the tray main body in an axial direction of the rotation, the rotation axis being axially supported by the apparatus main body; and a first portion that is connected to the flat tray main body; and an elastic tray protrusion that is provided on the first portion and protrudes in a radial direction of the rotation, the apparatus main body has a main-body contact portion that protrudes from the apparatus main body towards the tray main body, and when the support tray rotates with respect to the apparatus main body, the tray protrusion elastically crosses over the main-body contact portion to come into contact with the main-body contact portion, so that the reverse rotation of the support tray is prevented with respect to the apparatus main body.

2. The transport apparatus according to claim 1, wherein the tray protrusion elastically crosses over the main-body contact portion to come into contact with the main-body contact portion, to be positioned such that the support tray remains stationary in the closed state with respect to the apparatus main body.

3. The transport apparatus according to claim 2, wherein the tray protrusion elastically crosses over the main-body contact portion to come into contact with the main-body contact portion, to be further positioned such that the support tray remains stationary in the open state with respect to the apparatus main body.

4. The transport apparatus according to claim 3, wherein the support tray further includes a second portion that is connected to the tray main body and is provided inside the first portion with a slit therebetween.

5. The transport apparatus according to claim 4, wherein the second portion is shaped like a fan.

6. The transport apparatus according to claim 1, wherein the first portion is shaped like an arc surrounding the rotation axis.

* * * * *